United States Patent [19]

Miller et al.

[11] 4,037,519

[45] July 26, 1977

[54] HYDRAULIC SYSTEM

[75] Inventors: Wayne Russell Miller; Jan Vilas Seipp, both of Dubuque, Iowa; Garn Farley Penfold, East Moline, Ill.

[73] Assignee: Deere & Company, Moline, Ill.

[21] Appl. No.: 570,230

[22] Filed: Apr. 21, 1975

[51] Int. Cl.[2] ..... F01B 25/26; F01B 31/12

[52] U.S. Cl. ..... 91/1; 91/35; 91/358 A; 91/361; 214/762; 214/764; 318/663; 318/672

[58] Field of Search ..... 91/1, 358 A, 361, 275, 91/459, 35, 359, 410; 318/663, 672, 674, 676; 251/68; 214/762, 763, 764

[56] References Cited

U.S. PATENT DOCUMENTS

| | | | |
|---|---|---|---|
| 3,026,638 | 3/1962 | Hayner | 172/4.5 |
| 3,420,393 | 1/1969 | Omon | 91/358 A |
| 3,487,958 | 1/1970 | Shook | 214/762 |
| 3,547,293 | 12/1970 | Borer | 214/764 |
| 3,732,892 | 5/1973 | Bubula | 137/609 |
| 3,752,189 | 8/1973 | Marr | 318/674 |
| 3,782,250 | 1/1974 | Kiszewski | 91/433 |
| 3,915,325 | 10/1975 | Lark | 318/674 |

*Primary Examiner*—Martin P. Schwadron
*Assistant Examiner*—Abraham Hershkovitz

[57] ABSTRACT

An electro hydraulic system for controlling a hydraulic function includes a pump and a reservoir connected to the function through a manually operable, electro-hydraulic control valve. The valve is positionable to either side of a neutral ports blocked position and may be held to one side by the engaging of a spring loaded detent. The detent is disengaged by an electrical signal produced by a comparator when a preset, operator-controlled, limiting signal is equalled by a feed back sensor signal proportional to the output of the function. The system will allow initial activation of the valve to provide continuous operation of the function until the limiting input is reached at which time the function will be stopped. The system further provides manual override of the electrical control system to permit operation of the valve when the feedback signal is greater than the limiting input signal.

5 Claims, 2 Drawing Figures

FIG. 1
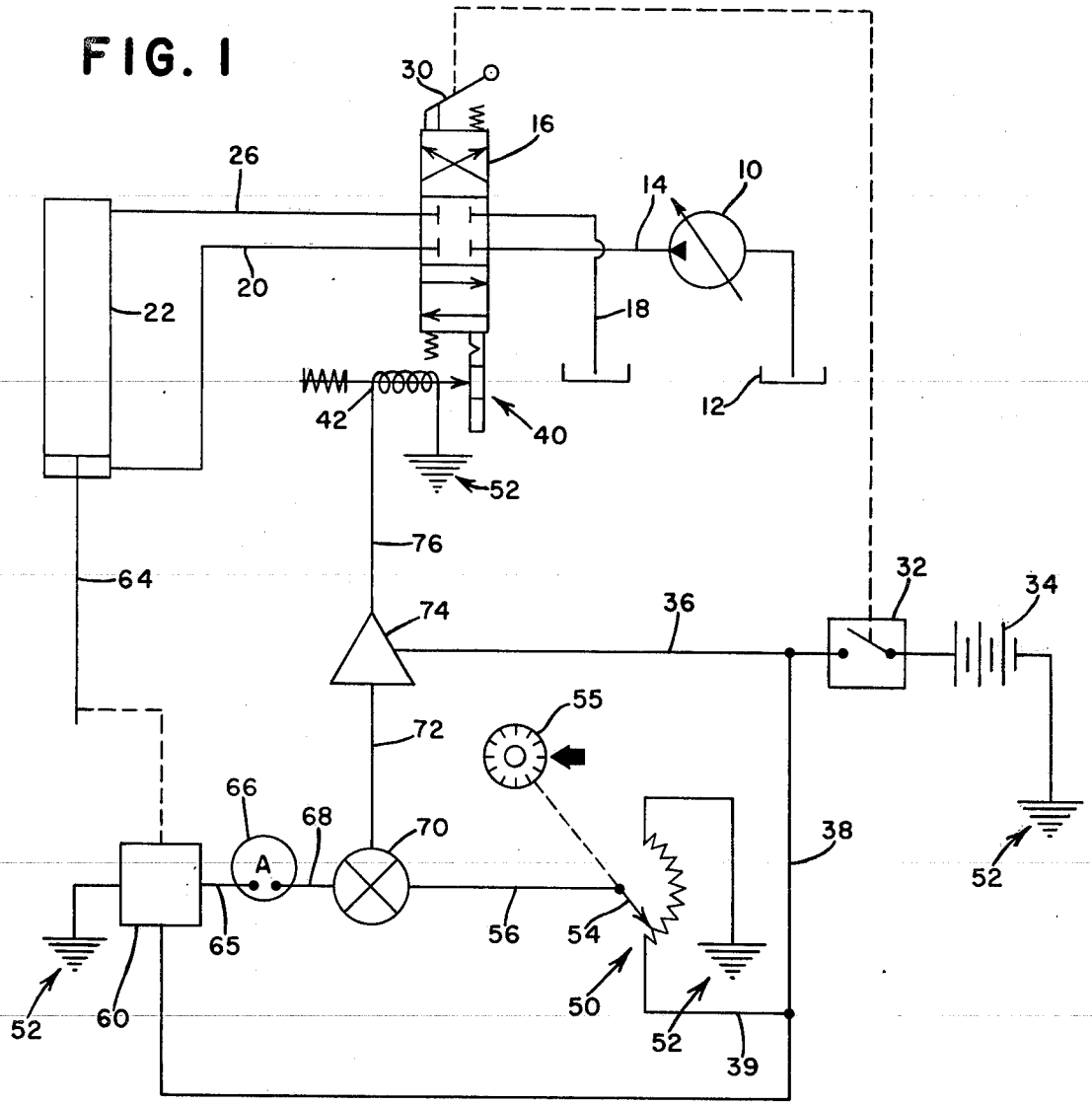
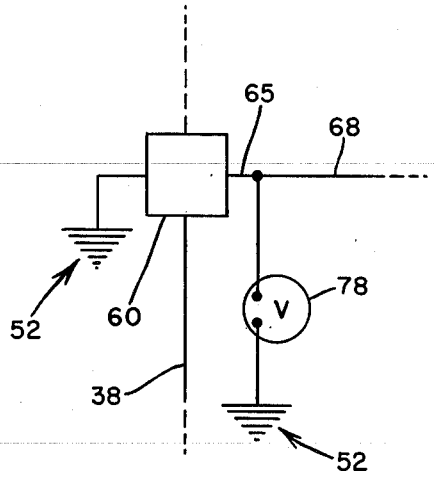
FIG. 2

HYDRAULIC SYSTEM

BACKGROUND OF THE INVENTION

The present invention relates generally to hydraulic systems and more particularly to electro-hydraulic systems.

In the past, various types of elctro-hydraulic control systems have been developed which employed mechanical, electrical or hydraulic feedback means, but none have provided remote electrical limiting of the movement of a hydraulic function after initial impulse initiation of the hydraulic function operation. Similarly, none of the systems have provided for manual override of the electrical limiting control without influencing the limiting control.

SUMMARY OF THE INVENTION

It is a general object of the present invention to provide an electro-hydraulic control system incorporating combined electric and hydraulic circuitry to allow initial manual activation of a hydraulic function and automatic deactivation upon obtaining a desired, adjustable hydraulic function output.

The above and additional objectives and advantages of the invention will become apparent to those skilled in the art by a reading of the following detailed description of the preferred embodiments of the invention when taken in conjunction with the accompanying drawings.

BRIEF DESCRIPTION OF THE DRAWINGS

FIG. 1 is an electrical and hydraulic schematic illustrating the features of the present invention.

FIG. 2 is a partial schematic of an alternate embodiment of the present invention.

DESCRIPTION OF THE PREFERRED EMBODIMENT

Referring now to FIG. 1, the hydraulic system according to the invention includes a main variable displacement, pressure compensated, hydraulic pump 10 supplied from a reservoir 12 and supplying pressurized fluid through a supply line 14 to a first port in the first side of a control valve 16. The control valve 16 is a conventional three-position, four-way fluid control valve which is biased towards a central, neutral, ports blocked position. A reservoir line 18 connects a second port in the first side of the control valve 16 with the reservoir 12.

A first port in the second side of the control valve 16 is connected by a first fluid passage 20 to a first port in a fluid motor or hydraulic cylinder 22. The hydraulic cylinder 22 is representative of any of the conventional hydraulic functions. A second port in the second side of the control valve 16 is connected to a second port in the cylinder 22 by a second fluid passage 26.

The control valve 16 is manually positioned by a manual operator control lever 30 which selectively positions the control valve 16 between its three positions and also selectively opens and closes a normally-open power switch 32 which connects a source of electrical power 34 with a main lead 36 as will hereinafter be described. Associated with the control valve 16 is a spring loaded detent 40 which will engage the control valve 16 to hold it in one position when it is moved into that position by the control lever 30. The detent 40 will be disengaged from the control valve 16 when a detent solenoid 42 is energized as will hereinafter be described.

The aforementioned main lead 36 is connected by leads 38 and 39 to an operator controlled, limiting input potentiometer 50 and thence to a ground 52. The potentiometer 50 includes a selector wiper 54 having a calibrated dial 55 and connected to a limiting input lead 56. The lead 38 is further connected to a conventional feedback, function sensor transducer 60 and thence to ground 52. The transducer 60 is operatively connected to a cylinder rod 64 of the cylinder 22. A sensor output lead 65 connects the function sensor transducer with a visual indicator or ammeter 66. The ammeter 66 is calibrated to relate the cylinder rod 64 extension to the current flow through the function sensor transducer 60. The ammeter 66 is further connected to a function output lead 68.

The limiting input lead 56 and the function output lead 68 are connected to a comparator 70 of known circuit configuration. A comparator output lead 72 connects the comparator 70 with an amplifier circuit 74 also of known circuit configuration. The amplifier circuit 74 is energized by connection to the source 34 through the main lead 36 and the power switch 32. An amplifier output lead 76 connects the amplifier circuit 74 with the detent solenoid 42 which is further connected to ground 52.

The hydraulic control system of the present invention is used in the boom height control of a wheel loader where it is desirable for the operator to be able to raise the boom by actuating and then releasing the control lever 30 while the boom automatically raises to a preset height so that the operator is free to move the wheel loader while the boom is rising. This capability of stopping the boom at a predetermined height without operator guidance greatly increases the operator's productivity.

The hydraulic system is operated by the operator setting a desired limiting level on the calibrated dial 55 which sets the limiting input potentiometer 50 at a resistance proportional to the height at which the boom is to be stopped.

The operator then momentarily actuates the control lever 30 to shift the control valve 16 to the position wherein the spring loaded detent 40 engages. In this position the supply line 14 is connected to the second fluid passage 26 and the reservoir line 18 is connected to the first fluid passage 20 such that the cylinder 22 extends. The actuation of the control lever 30 also closes the normally-open power switch 32 to connect the source 34 to the amplifier circuit 74, the limiting input potentiometer 50 and the function sensor transducer 60.

As the cylinder rod 64 of the cylinder 22 extends, the resistance of the function sensor transducer 60 decreases proportionally causing increasing current flow. The increasing current flow from the function sensor transducer 60 is compared with the preset current flow from the limiting input potentiometer 50 by the comparator circuit 70.

When the current flows balance, the comparator circuit 70 provides an output signal to the amplifier circuit 74 which in turn energizes the detent solenoid 42 to disengage the detent 40. When the detent 40 is disengaged, the control valve 16 returns to its central, neutral, ports-blocked position which stops movement of the cylinder rod 64. Return of the control valve 16 to its neutral position moves the control lever 30 to a neutral position which opens the power switch 32. With power switch 32 open, the detent solenoid 42 is de-energized and the system returns to a dormant state.

The cylinder rod 64 can be extended to a position greater than the limiting extension set by the limiting input potentiometer 50 by manually holding the control lever 30 in a position wherein the control valve 16 connects the pump 10 and reservoir 12 to force the cylinder 22 to extend. Then the control lever 30 is in this position, the power switch 32 is closed and the detent solenoid 42 is energized disengaging the detent 40 (as long as the cylinder rod 64 is greater than the limiting extension). When the control lever 30 is released, the detent solenoid 42 will continue to be energized until the control valve 16 returns to its neutral position.

The indicator 66 is provided to provide a visual indication of function sensor output so that the operator may tell the extent of the cylinder 22 extension. In FIG. 1, the visual indicator is an ammeter connected directly between the function sensor transducer 60 and the comparator circuit 70 to measure current flow.

Referring now to FIG. 2, there is shown an alternate embodiment wherein a visual indicator 78 is connected between the output sensor lead 65 and the ground 52. In this alternate, embodiment, the visual indicator is a voltmeter which is calibrated to relate the cylinder rod 64 extention to the voltage drop across the function sensor transducer 60.

While the invention has been described in conjunction with specific embodiment, it is to be understood that many alternatives, modifications, and variations will be apparent to those skilled in the art in light of the aforegoing description. Accordingly, it is intended to embrace all such alternatives, modifications, and variations which fall within the spirit and scope of the appended claims.

We claim:

1. An electro-hydraulic system comprising: a fluid reservoir; a fluid source of pressurized fluid; fluid function means providing a mechanical output and having at least one port; fluid passage means connected to the port; function control means operatively associated with the fluid source and the reservoir for controlling pressurized fluid in the fluid passage means and positionable to normally block or selectively connect the fluid source and the reservoir from and to the fluid passage means; manually operable input means operatively associated with the function control means providing an input for selectively positioning the function control means; releasable means intermeshable with the function control means and the input means for positively holding the function control means in a hold position connecting the fluid source to the fluid passage means and to cause the releasable means to withdraw from mesh with the function control means in response to a manual input positioning the function control means away from the hold position or to an electrical release current; an electrical current source, function sensor means operatively associated with the function means and providing an electrical output current proportional to the function means mechanical output; manually operable limiting means providing an electrical limiting current proportional to desired function means mechanical output; control means operatively associated with the function sensor means, the limiting means, and the releasable means for comparing the function sensor means output current and the limiting current and providing the electrical release current to the releasable means when the output current is equal or greater than the limiting current; and power switching means responsive to the input means positioning of the function control means in and away from the hold position to connect and disconnect, respectively, the electrical current source to and from the function sensor means, the limiting means, and the control means to provide electrical current thereto.

2. The electro-hydraulic system as claimed in claim 1 wherein the function control means includes control valve means biased toward blocking the fluid passage means from the source and the reservoir, the manually operable input means includes means for selectively positioning the control valve means, and the releasable means includes detent means for intermeshing with the control valve means in a position wherein the fluid source is connected to the fluid passage means, said releasable means further includes solenoid means responsive to the electrical release current to disengage the detent means.

3. The electro-hydraulic system as claimed in claim 1, including visual indicator means operatively associated with the function sensor means responsive to the function sensor means electrical output current to provide a visual indication proportional thereto.

4. An electro-hydraulic system comprising: a fluid reservoir; a fluid source of pressurized fluid; fluid function means providing a mechanical output and having a first and second ports; first and second fluid passage means connected to first and second ports, respectively, control valve means selectively movable to a first side of a neutral position to connect the first fluid passage means to the reservoir and the second fluid passage means to the fluid source or a second side to connect the first fluid passage means to the fluid source and the second fluid passage means to the reservoir; means for continuously biasing the control valve means to the neutral position; manually operable control input means for selectively moving the control valve means to the different positions; detent means intermeshable with the control valve means and the control input means for positively holding the control valve means to the second side of the neutral position to connect the first fluid passage means to the reservoir and the second fluid passage means to the fluid source when so positioned by the control input means and to withdraw from mesh when control input means positions the function control means away from the second position; detent solenoid means responsive to an energization current to disengage the detent means; an electrical current source; current transducer means operatively associated with the function means providing an output current proportional to the function means mechanical output; manually operable limiting potentiometer means providing a current proportional to maximum desired function means output; comparator means responsive to the transducer output equal to or greater than limiting means input to produce a comparator means output current; and amplifier means responsive to the comparator means output current to amplify the current from the comparator means and provide the energization current to the detent solenoid means to disengage the detent means from the control valve means, and power switching means responsive to the control input means positioning of the function control means in and away from the hold position to connect and disconnect, respectively, the electrical current source to and from the function sensor means, the limiting means, the comparator means, and the amplifier means.

5. The electro-hydraulic system as claimed in claim 4 including ammeter means connected between the transducer means and the comparator means to provide a visual indication of the output signal proportional to the function means output.

* * * * *